United States Patent [19]

Zakrzewski

[11] Patent Number: 4,602,387

[45] Date of Patent: Jul. 29, 1986

[54] WEIGHT VEST

[76] Inventor: Jacek M. Zakrzewski, 332 Water St., Keene, N.H. 03431

[21] Appl. No.: 660,909

[22] Filed: Oct. 15, 1984

[51] Int. Cl.[4] ..... A41D 1/04; F41H 1/02

[52] U.S. Cl. ..... 2/102; 2/2.5

[58] Field of Search ..... 2/102, 2.5, 2, 94

[56] References Cited

U.S. PATENT DOCUMENTS 1,657,866 1/1929 Mooney ..... 2/2

2,954,563 10/1960 De Grazia ..... 2/2.5

3,500,472 3/1970 Castellani ..... 2/2

4,322,858 4/1982 Douglas ..... 2/2

*Primary Examiner*—Doris L. Troutman

[57] ABSTRACT

A weight vest which is fully foam lined, sewn canvas, incorporating means for wearing an adjustable amount of weight upwards to fifty pounds, also means to retain said weights within specially shaped pockets conforming to weight shape by means of an elastic strap capturing an exposed end of the weight. Also providing means to adjust the vest size to fit various body shapes by means of side strap lace adjustment with a zipper front.

3 Claims, 7 Drawing Figures

FIG. 1
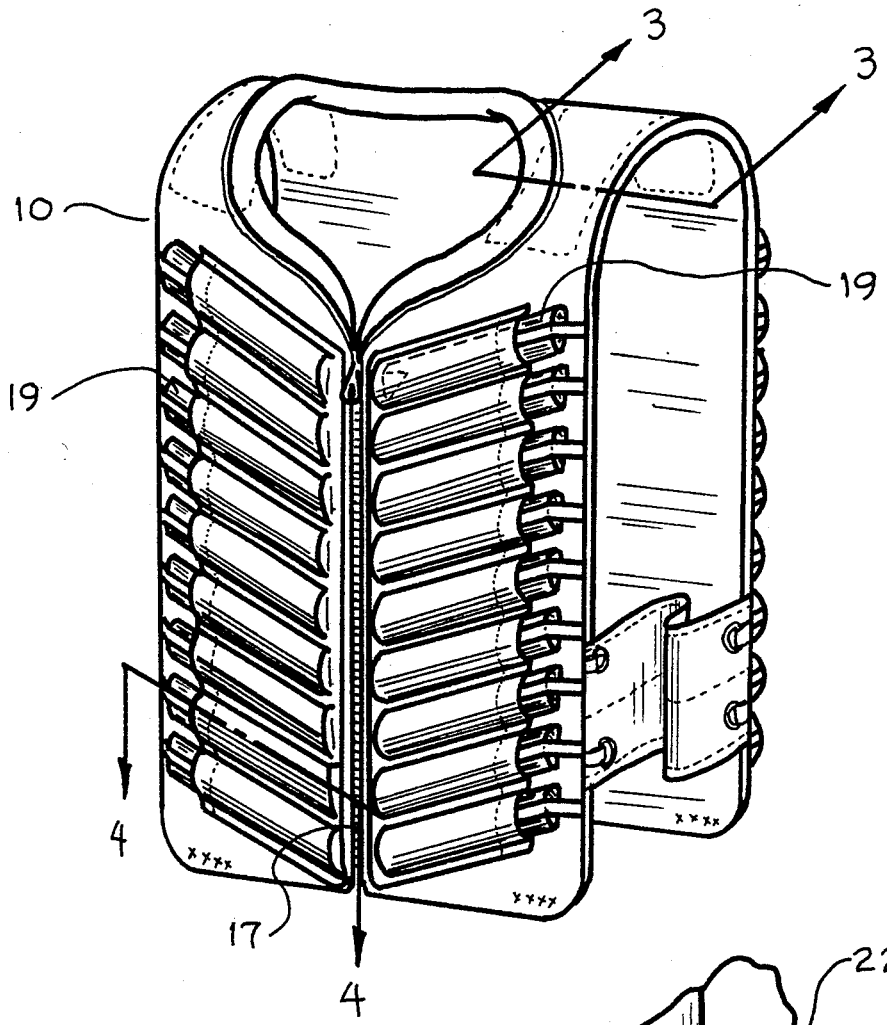
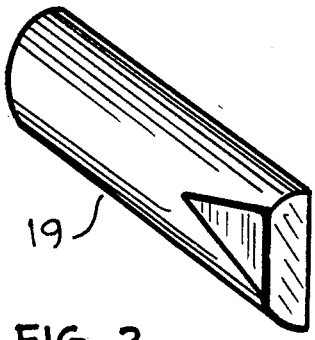
FIG. 2
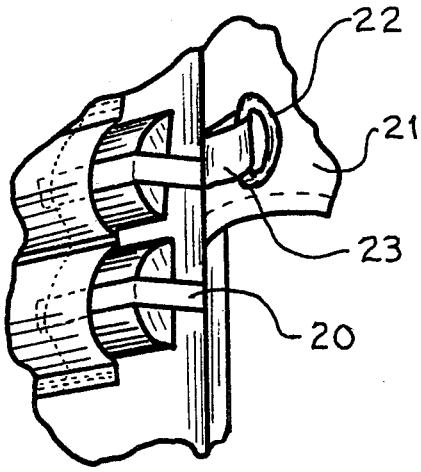
FIG. 5

FIG. 4
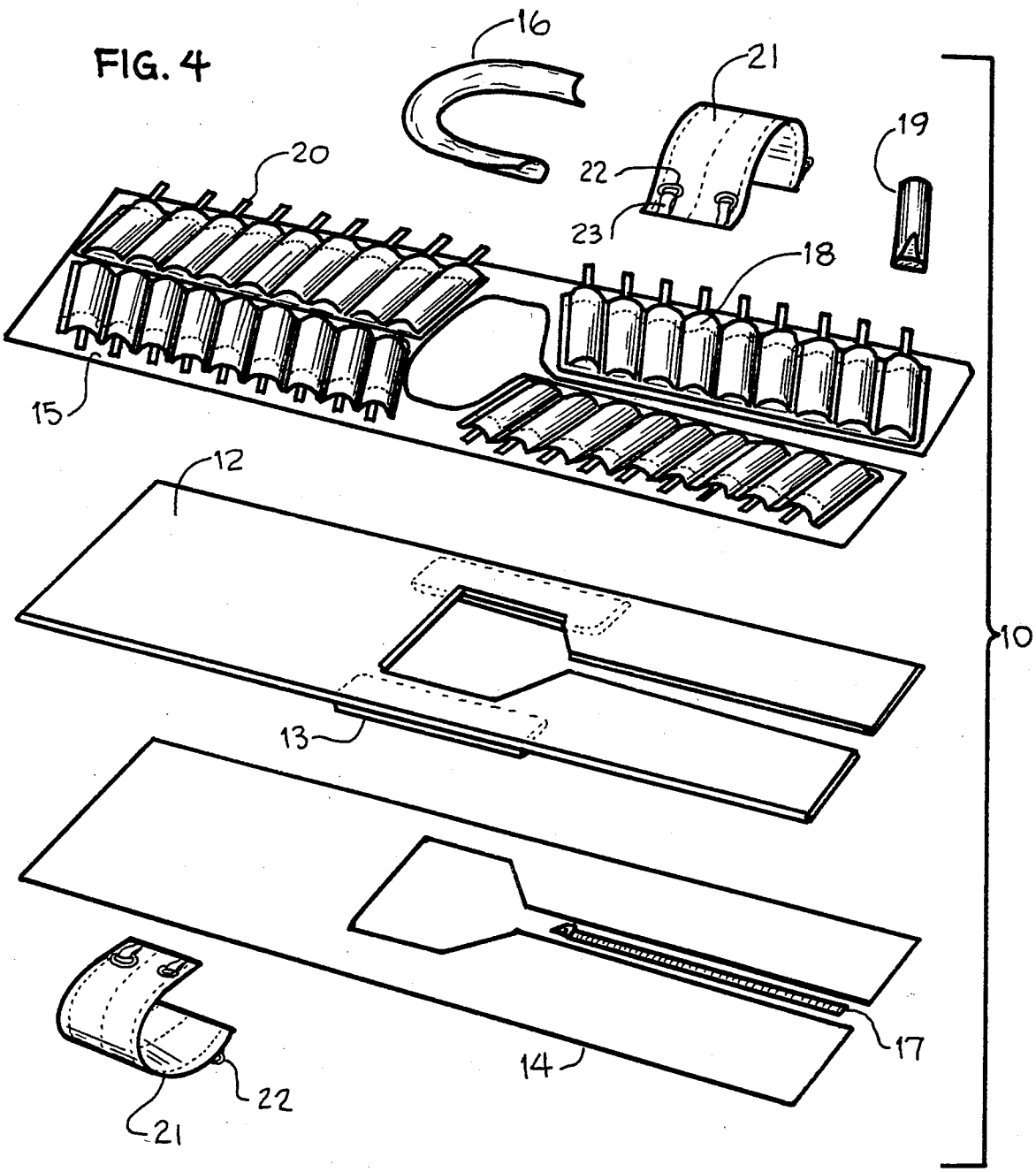
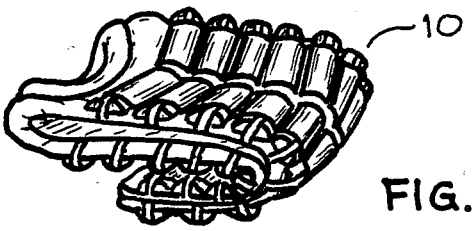
FIG. 3

WEIGHT VEST

CROSS-REFERENCE TO RELATED APPLICATIONS

| | | |
|---|---|---|
| U.S. Pat. No. 4,268,917 | 5/1979 | Massey |
| U.S. Pat. No. 4,332,379 | 7/1980 | Bannister |
| U.S. Pat. No. 4,344,620 | 11/1979 | Debski |
| U.S. Pat. No. 4,382,302 | 3/1981 | Watson |

BACKGROUND OF THE INVENTION

1. Field of the Invention

This invention related to weighted apparel, and more particularily to vests worn by athletes for the purpose of weight resistance training.

2. Prior Art

In sports and fitness training, players endeavor to increase strength and physical abilities by wearing weight upon the upper body during exercise.

Numerous weight vests and weight-carrying packs have been developed, however the need for more flexible weighted apparel which provides variable weight distribution, accurately incrementated weight adjustment, and reliable means of positively retaining individual weights in their separate locations for prevention of accidental loss, dislocation, or excessive movement during use are still desired.

For example; in prior art U.S. Pat. Nos. 4,268,917 and 4,332,379, there are provided vertical weight-carrying pockets or members which require the user to measure, incrementate, and otherwise provide loose or bulk weighty material, to be loaded, of necessity, from the bottom upwards in said weight-carrying means, thus making it difficult to variably distribute the weight, and providing no means of accurate weight control.

Also, vertical weight-carrying means or pockets, when fully loaded become restrictive to the natural flexibility of the upper body when bending forward or backward.

In prior art U.S. Pat. No. 4,334,620; compartments are provided for carrying air or weighty liquid, which can be inconvenient to measure, weigh, and increment, and in order to hold sufficient capacities of weight, said compartments of necessity become bulky and restrictive to the freedom of movement required in exercising. In addition, if said liquid compartments are not filled to capacity, there results a fluidic movement commonly experienced in the transport of liquids, which is undesirable in exercises requiring careful balancing or quick direction changes.

In prior art U.S. Pat. No. 4,382,302; means are provided for carrying individual weights with rigidifying means extending between said weights to resist motion during use, however, said prior art provides no positive means for preventing individual weights from being accidentally dislodged or removed during rigorous use, and said rigidifying means extending between weights detract from freedom of movement required in exercising.

SUMMARY OF THE INVENTION

Therefore, it is an object of this invention to provide an improved weight vest to be worn by exercise enthusiasts, that can be conveniently loaded with individual weights of uniform shape and weight, and adjusted in fixed increments of approximately one and three-eights pounds upwards to approximately fifty pounds.

Another object of this invention is to provide a weight vest with means of positively retaining each weight within a seperate, individual pocket, thus allowing the location of weights to be distributed to suit the user, and preventing accidental loss or unwanted movement of weights during use, and facilitating easy insertion and removal of each weight.

Still another object of this invention is to provide a weight vest with the advantage of being soft against the body, adjustable to fit various body sizes, and which provides weight resistance without restricting natural body motions or flexibility.

Other objects and advantages will become apparent during the course of the following descriptions of the invention.

BRIEF DESCRIPTION OF THE DRAWINGS

FIG. 1 is a perspective view of vest 10 looking at the front.

FIG. 2 is a perspective view of specially contoured steel weight 19 looking into wedge shaped end.

FIG. 3 is a perspective view showing vest 10 in a folded position.

FIG. 4 is an exploded perspective view of vest 10.

FIG. 5 is an enlarged perspective view taken from FIG. 1.

DESCRIPTION OF THE PREFERRED EMBODIMENT

Figure 6:
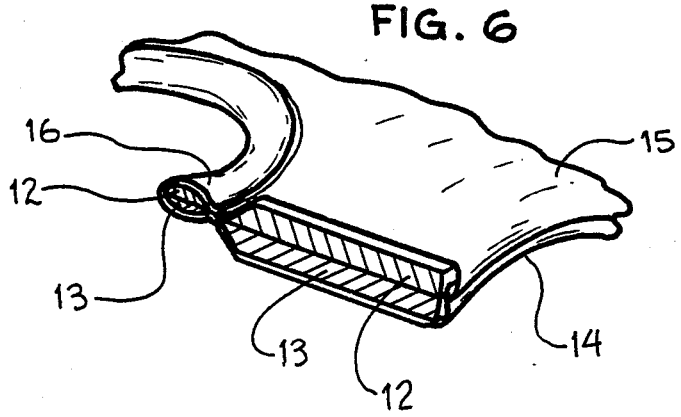
FIG. 6 is a cross-sectional view taken on line 3—3.
Figure 7:
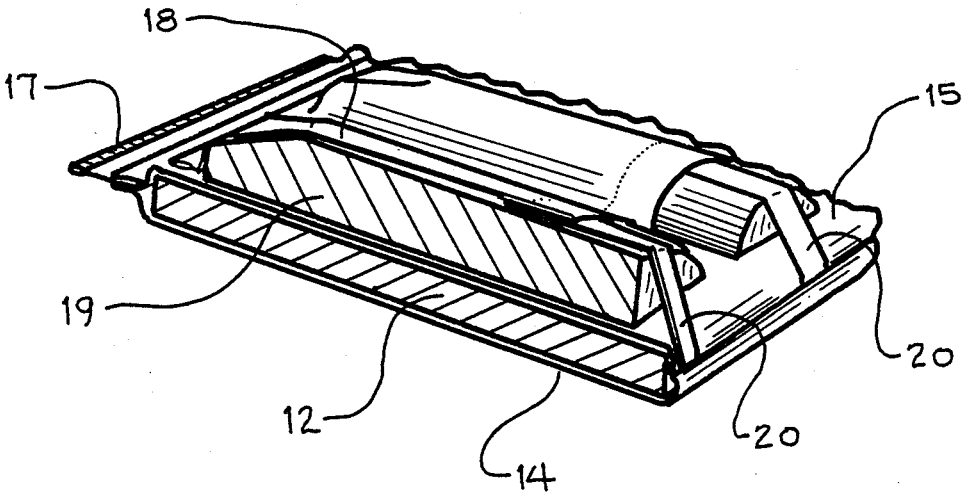
FIG. 7 is a cross-sectional view taken on line 4—4.

The weight vest 10 shown in FIGS. 1 to 7 comprises a foam liner 12 which has an additional layer of foam 13 permanentaly bonded to its underside, is split on one end to allow for installation of a seperating zipper 17, and is completely encased in canvas by means of the lower section 14 and upper section 15 which are sewn with all edges facing inward as shown in FIG. 6.

The foam is held in place by means of a neck band 16 and also by tack stitching in the four lower corners of vest 10, shown in FIG. 1.

Connection of the upper section 15 and lower section 14 in the front is achieved when the seperating zipper 17 is sewn in, thereby encasing the entire foam line 12 and 13.

The upper section has attached to it four pocket quarters 18, prior to assembly to the lower section 14. Each of the four pocket quarters 18 has nine specially shaped pockets to conform the the radius of the steel weight 19, spaced equally apart so as to allow for flexibility when the vest 10 is loaded with weighte 19. The pocket quarters 18 are sewn with one end closed and angled downward toward the center of the vest 10 to provide for further flexibility and allow the weights 19 to sink into the pocket, toward the center of gravity, when the vest is worn. Note that the pockets angle downward to the zipper in front and downward toward the bottom center in back. See FIG. 4.

The upper end in each pocket in the pocket quarter 18 is open to allow for inserting of the weight 19, and the confine of the pocket is such so as to allow a portion of the weight to remain exposed when fully inserted, to allow for grasping the weight, 19.

Sewn into the underside of each pocket in the pocket quarters 18, at the open end, is a retainer strap 20 which is sewn between the upper section 15 and lower section 14 during final assembly of vest 10, allowing sufficient length of retainer strap 20 to cover the exposed end of the weight 19 when fully inserted in pocket. Insertion and removal of the individual weights 19 is achieved by pulling retainer strap 20 to one side of the weight 19 and thereby allowing the weight to slide in or be pulled out. Weights 19 cannot fall out when the retainer strap 20 is in place.

Adjusting the vest 10 to various body sizes is achieved by two side straps 21 which are also sewn between the upper and lower sections 14 and 15. Each side strap 21 has four steel 'D' rings 22 attached to is by means of the ring strap 23.

Adjustment is achieved by tying laces (not shown) through the 'D' rings 22 and setting for a snug fit around waist.

After the side straps 21 have been adjusted, the seperating zipper front 17 allows the vest 10 to be used repeatedly without further re-adjustment of fit.

I claim:

1. An adjustable weight vest comprising a sleeveless vest having a front and rear portion provided with four columns of a plurality of weight holding means in the form of individual pockets, two of the said columns in front being located on opposite sides of a medial line and extending from slightly below the shoulders to the waist, and connected to each other by a seperating zipper extending substancially the length of said pocket columns on said medial line, and two of the columns in the rear portion of the vest being located on opposite sides of a medial line and extending from slightly below the shoulders to the waistline, said rear columns being connected to said front columns on each side by single straps extending from below the underarm to slightly above the waistline, each said side strap having a plurality of rings attached to each extreme end of said side strap outer surface, through which are laced strings or other suiablle tying means, and said four pocket columns consisting of said plurality of individual pockets, with each said pocket having one end open and one end closed, with said closed end being nearest the said medial line of vest and slightly lower from the horizontal than said open end, and each said individual pocket being uniformily shaped and spaced apart, so as to accept within itself a half-round, elongated weight, said weight having one end wedged slightly flat, and each said individual pocket being os a uniform depth so as to leave a portion of each said weight exposed out of open end of said individual pockets;

and said open end of each said individual pocket having an elastic band attached to and extending across said opening so as to extend over exposed end of said inserted individual weight, thereby retaining said inserted weight within said individual pocket;

and said sleeveless vest comprising an inner and outer layer sandwiching and totally encasing a soft, weight absorbing material.

2. A weight vest as defined in claim 1 wherein said individual pocket means slightly spaced apart and angled slightly from the horizontal plane includes means of preventing restrictions to flexibility during use, and means of enhancing distribution of forces toward vest center during use, and said elastic band means including means of restricting motions and preventing loss of said individual weights during use;

and said individual pocket means including means of exposing said portion of said individual weight.

3. A weight vest as defined in claims 1 and 2 wherein said side strap means include means of adjusting size and fit of said weight vest means, seperately and independantly of seperating zipper means, and seperating zipper means including means of putting on or removing said weight vest means independantly and seperatly of side strap adjustment means;

and said individual weight means including means of enhancing insertablity of said weight means into said pocket means by means of said slightly wedged weight end.

* * * * *